US010082764B2

(12) United States Patent
Yamane et al.

(10) Patent No.: US 10,082,764 B2
(45) Date of Patent: Sep. 25, 2018

(54) DEVELOPING DEVICE, IMAGE FORMING APPARATUS, MAGNETIC POLE POSITION CORRECTING METHOD

(71) Applicant: KYOCERA Document Solutions Inc., Osaka-shi, Osaka (JP)

(72) Inventors: Shinji Yamane, Osaka (JP); Takuji Watanabe, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/838,128

(22) Filed: Dec. 11, 2017

(65) Prior Publication Data

US 2018/0173157 A1 Jun. 21, 2018

(30) Foreign Application Priority Data

Dec. 20, 2016 (JP) ..... 2016-246712

(51) Int. Cl.
*G03G 15/09* (2006.01)
*G03G 21/16* (2006.01)

(52) U.S. Cl.
CPC ..... *G03G 21/1676* (2013.01); *G03G 21/1604* (2013.01); *G03G 2215/0619* (2013.01)

(58) Field of Classification Search
USPC ..... 399/252, 258, 265, 267, 274, 275, 279, 399/281, 282, 286
See application file for complete search history.

(56) References Cited

U.S. PATENT DOCUMENTS 4,660,958 A * 4/1987 Egami ..... G03G 15/09 399/273
6,721,526 B2 * 4/2004 Shigeta ..... G03G 9/0819 399/267
6,937,830 B2 * 8/2005 Satoh ..... G03G 21/203 399/92
7,787,808 B2 * 8/2010 Aimoto ..... G03G 15/09 399/107

FOREIGN PATENT DOCUMENTS

JP 09146365 A 6/1997

* cited by examiner

*Primary Examiner* — Hoan Tran
(74) *Attorney, Agent, or Firm* — Alleman Hall Creasman & Tuttle LLP

(57) ABSTRACT

A developing device includes a developing roller and a developing magnetic pole. The developing roller is disposed to face an image carrier across a predetermined gap. The developing magnetic pole is provided in the developing roller so as to be displaced between first and second magnetic pole positions. When the developing magnetic pole is at the first magnetic pole position, a magnetic field is generated at a first position in the gap. When the developing magnetic pole is at the second magnetic pole position, a magnetic field is generated at a second position in the gap. When a circumferential speed ratio of the developing roller to the image carrier is increased, the developing magnetic pole is displaced toward the second magnetic pole position, and when the circumferential speed ratio is decreased, the developing magnetic pole is displaced toward the first magnetic pole position.

12 Claims, 7 Drawing Sheets

DEVELOPING DEVICE, IMAGE FORMING APPARATUS, MAGNETIC POLE POSITION CORRECTING METHOD

INCORPORATION BY REFERENCE

This application is based upon and claims the benefit of priority from the corresponding Japanese Patent Application No. 2016-246712 filed on Dec. 20, 2016, the entire contents of which are incorporated herein by reference.

BACKGROUND

The present disclosure relates to a developing device of a non-contact developing system, an image forming apparatus including a developing device, and a magnetic pole position correcting method applied to a developing device.

In an image forming apparatus such as a copier or a printer that forms an image on a paper sheet by an electrophotographic system, a developing device is installed. The developing device develops, with toner, an electrostatic latent image that has been formed on a photoconductor drum (image carrier). The developing device includes a developing roller that is disposed separate from the photoconductor drum by a predetermined gap. One of known developing systems is a non-contact developing system in which developer is magnetically drawn up from a developer storage chamber to the surface of the developing roller, and toner is flown from the developing roller to the electrostatic latent image on the photoconductor drum by an electric field generated by a developing bias applied to the developing roller.

There is known a developing device of the above-mentioned non-contact developing system in which the developing roller is controlled to operate at a linear speed higher than that of the photoconductor drum. In this developing device, the linear speed of the developing roller is adjusted in correspondence with the operation mode of the image forming apparatus.

In addition, a cooling fan for cooling a cooling target is provided in a conventional image forming apparatus, wherein the cooling target is an exposure device, a developing device, a fixing device and the like provided in the image forming apparatus. The cooling fan is configured to blow air to the devices in the image forming apparatus. In addition, this type of image forming apparatus includes a temperature sensor in the periphery of the cooling target, and the blowing amount of the cooling fan is adjusted based on the temperature detected by the temperature sensor.

SUMMARY

A developing device according to an aspect of the present disclosure includes a developing roller and a developing magnetic pole. The developing roller is disposed to face an image carrier across a predetermined gap, wherein the image carrier is configured to keep a toner image formed from supplied toner on an outer circumferential surface of the image carrier. In addition, the developing roller is configured to be rotationally driven. The developing magnetic pole is provided in an inside of the developing roller, and is configured to be displaced between a first magnetic pole position and a second magnetic pole position. When the developing magnetic pole is disposed at the first magnetic pole position, a magnetic field is generated at a predetermined first position in the gap. When the developing magnetic pole is disposed at the second magnetic pole position, a magnetic field is generated at a second position in the gap, the second position being on an upstream side of the first position in a rotation direction of the developing roller. When a circumferential speed ratio of the developing roller to the image carrier is increased, the developing magnetic pole is displaced toward the second magnetic pole position, and when the circumferential speed ratio is decreased, the developing magnetic pole is displaced toward the first magnetic pole position.

An image forming apparatus according to another aspect of the present disclosure includes the developing device, the image carrier, and a magnetic pole position control portion. The image carrier is disposed to face the developing roller of the developing device across the gap, and configured to keep the toner image on the outer circumferential surface of the image carrier, the toner image being formed from the toner supplied from the developing roller. In addition, the image carrier is configured to be rotationally driven. The magnetic pole position control portion is configured to determine an amount of change of the circumferential speed ratio of the developing roller to the image carrier, and displace the developing magnetic pole by a displacement amount that corresponds to the determined amount of change.

A developing device according to a further aspect of the present disclosure includes a developing roller and a developing magnetic pole. The developing roller is disposed to face an image carrier across a predetermined gap, wherein the image carrier is configured to keep a toner image formed from supplied toner on an outer circumferential surface of the image carrier. In addition, the developing roller is configured to be rotationally driven. The developing magnetic pole is provided in an inside of the developing roller, and is configured to be displaced between a first magnetic pole position and a second magnetic pole position. When the developing magnetic pole is disposed at the first magnetic pole position, a magnetic field is generated at a predetermined first position in the gap. When the developing magnetic pole is disposed at the second magnetic pole position, a magnetic field is generated at a second position in the gap, the second position being on an upstream side of the first position in a rotation direction of the developing roller. When a blowing amount of air passing through the gap from the second position to the first position is increased, the developing magnetic pole is displaced toward the second magnetic pole position, and when the blowing amount is decreased, the developing magnetic pole is displaced toward the first magnetic pole position, An image forming apparatus according to still another aspect of the present disclosure includes the developing device, the image carrier, an air blowing fan, and a magnetic pole position control portion. The image carrier is disposed to face the developing roller of the developing device across the gap, and configured to keep the toner image on the outer circumferential surface of the image carrier, the toner image being formed from the toner supplied from the developing roller. The image carrier is configured to be rotationally driven. The air blowing fan is disposed in an inside of an apparatus main body and configured to blow air toward the gap. The magnetic pole position control portion is configured to determine an amount of change of the blowing amount of air passing through the gap from the second position to the first position, and displace the developing magnetic pole by a displacement amount that corresponds to the determined amount of change.

A magnetic pole position correcting method according to a still further aspect of the present disclosure corrects a position of a developing magnetic pole provided in an inside of a developing roller. The developing magnetic pole is configured to be displaced between a first magnetic pole position to generate a magnetic field at a predetermined first position in a predetermined gap between the developing roller and an image carrier, and a second magnetic pole position to generate a magnetic field at a second position in the gap, the second position being on an upstream side of the first position in a rotation direction of the developing roller. The magnetic pole position correcting method includes a circumferential speed ratio determining step and a position correcting step. The circumferential speed ratio determining step determines whether or not a circumferential speed ratio of the developing roller to the image carrier has changed. The position correcting step, when the circumferential speed ratio is larger than before the determination by the circumferential speed ratio determining step, displaces the developing magnetic pole toward the second magnetic pole position, and when the circumferential speed ratio is smaller than before the determination by the circumferential speed ratio determining step, displaces the developing magnetic pole toward the first magnetic pole position.

A magnetic pole position correcting method according to a still further aspect of the present disclosure corrects a position of a developing magnetic pole provided in an inside of a developing roller. The developing magnetic pole is configured to be displaced between a first magnetic pole position to generate a magnetic field at a predetermined first position in a predetermined gap between the developing roller and an image carrier, and a second magnetic pole position to generate a magnetic field at a second position in the gap, the second position being on an upstream side of the first position in a rotation direction of the developing roller. The magnetic pole position correcting method includes a blowing amount determining step and a position correcting step. The blowing amount determining step determines whether or not a blowing amount of air passing through the gap from the second position to the first position has changed. The position correcting step, when the blowing amount is larger than before the determination by the blowing amount determining step, displaces the developing magnetic pole toward the second magnetic pole position, and when the blowing amount is smaller than before the determination by the blowing amount determining step, displaces the developing magnetic pole toward the first magnetic pole position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and can be modified as necessary in a range where the gist of the present disclosure is not changed.

First Embodiment

Figure 1:
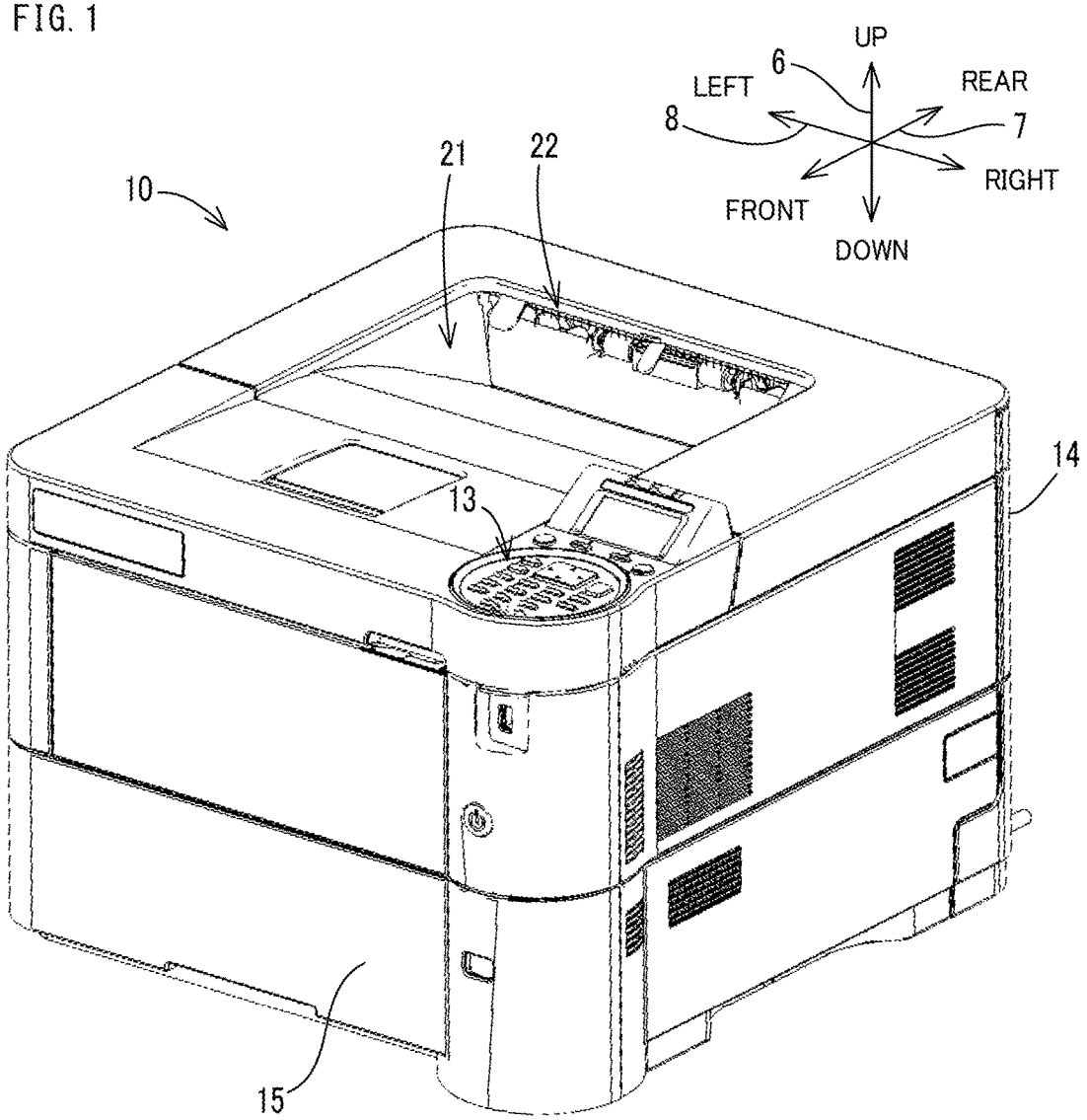
FIG. 1 is a perspective diagram showing an external appearance configuration of an image forming apparatus according to embodiments of the present disclosure.
Figure 2:
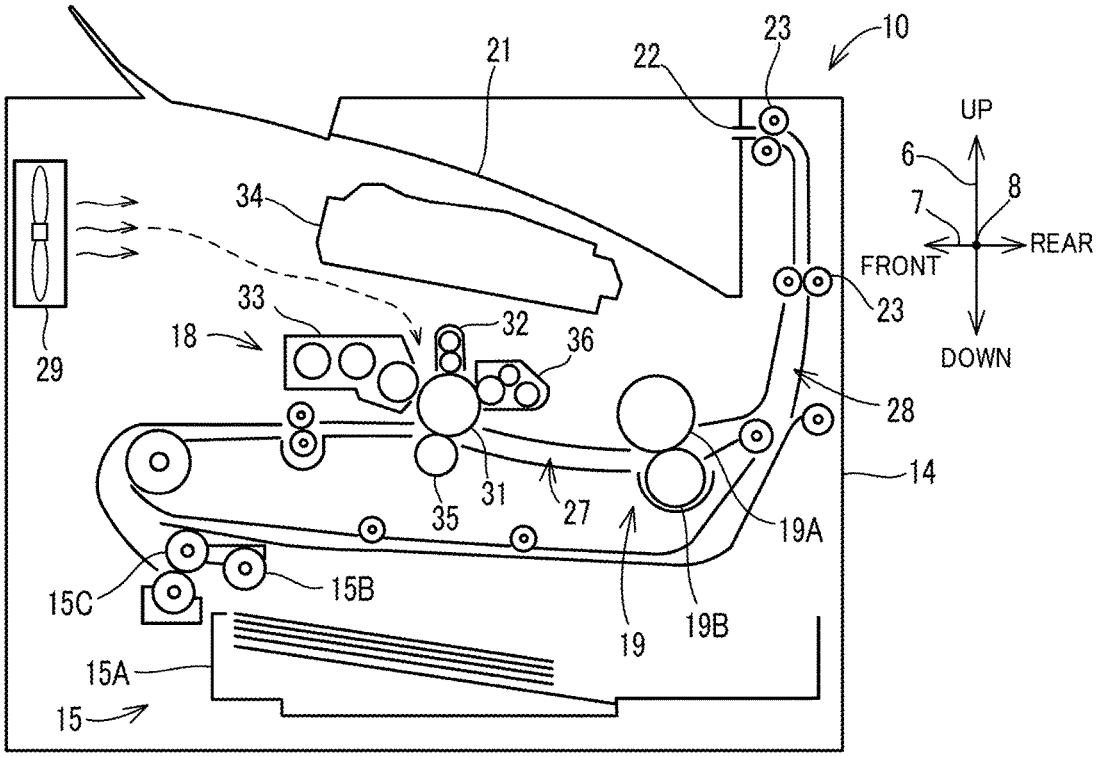
FIG. 2 is a cross-sectional diagram showing a configuration of the image forming apparatus.

In the following, a first embodiment of the present disclosure is described. FIG. 1 and FIG. 2 describe a configuration of an image forming apparatus 10 according to the present embodiment. FIG. 1 is a perspective diagram of the image forming apparatus 10. FIG. 2 is a cross-sectional diagram of the image forming apparatus 10. The image forming apparatus 10 is an example of the image forming apparatus of the present disclosure. It is noted that for the sake of explanation, an up-down direction 6 is defined based on the state where the image forming apparatus 10 is installed in a usable manner (the state shown in FIG. 1). In addition, a front-rear direction 7 is defined on the supposition that the front side (front) of FIG. 1 is the front, and a left-right direction 8 is defined on the basis of the image forming apparatus 10 viewed from the front side (front).

[Configuration of Image Forming Apparatus 10]

As shown in FIG. 1, the image forming apparatus 10 is a multifunction peripheral having a plurality of functions such as a printer function and a facsimile function. The image forming apparatus 10 prints an input image on a print sheet by using a print material such as toner. It is noted that the image forming apparatus 10 is not limited to a multifunction peripheral, but the present disclosure is applicable to a dedicated apparatus such as a printer, a facsimile, or a copier.

The image forming apparatus 10 is configured to print an image on a print sheet based on image data that is input from outside via a network communication portion (not shown). As shown in FIG. 2, the image forming apparatus 10 includes an operation panel 13, an electrophotographic image forming portion 18, a fixing device 19, a sheet feed device 15, a cooling fan 29 (an example of the air blowing fan of the present disclosure), a sheet discharge portion 21, and a control portion 90 for comprehensively controlling the image forming apparatus 10 (see FIG. 5). These components are disposed in a housing 14 (an example of the apparatus main body of the present disclosure) that constitutes a cover of an external frame, an internal frame and the like of the image forming apparatus 10.

As shown in FIG. 2, the sheet feed portion 15 is provided in a lowest part of the image forming apparatus 10. The sheet feed device 15 includes a sheet feed tray 15A, a pickup roller 15B, and a sheet feed roller 15C. The sheet feed tray 15A stores, in a stack, print sheets on which images are to be formed by the image forming portion 18. When an instruction to start feeding a print sheet is input to the image forming apparatus 10, the pickup roller 15B is rotationally driven by a conveyance motor (not shown), and a print sheet is fed from the sheet feed tray 15A. The print sheet fed by the pickup roller 15B is conveyed by the sheet feed roller 15C toward the downstream side in the feeding direction.

The image forming portion 18 forms an image on a print sheet of a prescribed size, based on image data input from outside. The image forming portion 18 transfers a toner image to the print sheet by using a print material such as toner. Specifically, as shown in FIG. 2, the image forming portion 18 includes a photoconductor drum 31 (an example of the image carrier of the present disclosure), a charging device 32, a developing device 33 (an example of the developing device of the present disclosure), a transfer device 35, a cleaning device 36, and an exposure device 34.

The photoconductor drum 31 is disposed to face a developing roller 63 that is described below, across a predetermined gap 68 (see FIG. 3), and is configured to carry, on its outer circumferential surface, a toner image formed from the toner supplied from the developing roller 63. The photoconductor drum 31 is rotationally supported by, for example, an internal frame of the image forming apparatus 10. A photosensitive layer is formed on the outer circumferential surface of the photoconductor drum 31. In the present embodiment, the photoconductor drum 31 has a cylindrical shape and has a diameter of 30.0 mm. A rotational driving force from a motor is transmitted to the photoconductor drum 31, and upon receiving the rotational driving force, the photoconductor drum 31 is rotationally driven to rotate in a predetermined direction (namely, a rotation direction opposite to the rotation direction of the developing roller 63).

In the present embodiment, the photoconductor drum 31 is rotationally driven so as to rotate at a linear speed of 200 mm/s during a normal print mode (an example of the low-quality image print mode of the present disclosure). In addition, the photoconductor drum 31 is rotationally driven so as to rotate at a linear speed of 100 mm/s during a high-quality print mode in which a higher-quality image is formed than during the normal print mode.

It is noted that whether to execute an image formation process in the normal print mode or in the high-quality print mode in the image forming apparatus 10 is determined based on a resolution that is set when an image forming instruction is input to the image forming apparatus 10. For example, when a resolution is set on the operation panel 13 of the image forming apparatus 10 or set by a printer driver of an information processing apparatus connected to the image forming apparatus 10, the set value of the resolution is transmitted to the control portion 90 of the image forming apparatus 10 (see FIG. 5). The control portion 90 executes the image formation process in the high-quality print mode when the set value of the resolution is equal to or higher than a predetermined resolution, and executes the image formation process in the normal print mode when the set value of the resolution is lower than the predetermined resolution.

The charging device 32 is disposed vertically above the photoconductor drum 31. In addition, the exposure device 34 is disposed at an upper part of the image forming portion 18, above the developing device 33, the charging device 32, and the cleaning device 36.

When an image forming operation is started, the charging device 32 uniformly charges the surface of the photoconductor drum 31 to a certain potential. In addition, the exposure device 34 scans a laser beam on the photoconductor drum 31 based on image data. In this processing, an electrostatic latent image is formed on the photoconductor drum 31. Subsequently, the developing device 33 develops a toner image on the photoconductor drum 31 by adhering the toner to the electrostatic latent image. The toner image is transferred by the transfer device 35, to a print sheet fed from the sheet feed tray 15A. The print sheet with the toner image transferred thereto is fed to a conveyance path 27 extending from the image forming portion 18 to the fixing device 19, and is conveyed to the fixing device 19 that is disposed more on the downstream side in the conveyance direction (namely, more on the rear side) than the image forming portion 18.

The fixing device 19 is configured to fix the toner image that has been transferred to the print sheet, to the print sheet by heat, and includes a heating roller 19A and a pressure roller 19B. The heating roller 19A is heated by a heating device, such as an IH heater, during a fixing operation. When the print sheet passes through the fixing portion 19, the toner is heated and fused by the fixing device 19. This allows the toner image to be fixed to the print sheet, thereby an image is formed on the print sheet. At this time, the print sheet is heated to a high temperature. The print sheet after the fixing passes along a conveyance path 28 to be conveyed upward, and is discharged from a sheet discharge port 22 to the sheet discharge portion 21 that is provided on an upper surface of the image forming apparatus 10.

The housing 14 has, in its inside, devices that generate heat when they are driven, such as the fixing device 19, the exposure device 34, and motors. As a result, the cooling fan 29 is provided in the housing 14 so as to decrease the internal temperature and cool the fixing device 19, the exposure device 34, and the motors. The cooling fan 29 is, for example, a sirocco fan (multi-blade fan). Of course, the cooling fan 29 is not limited to the sirocco fan, but is applicable to a variety of types of air blowers including an axial fan. The cooling fan 29 is attached to an inner surface of a front panel of the housing 14. Specifically, the cooling fan 29 is attached to an upper part of the inner surface. The cooling fan 29 sucks outside air through an inlet port (not shown) formed in the housing 14 and blows the air into the housing 14.

In addition, when the internal temperature of the housing 14 increases as heat is generated by the fixing device 19, the exposure device 34 and the like, the internal temperature of the developing device 33 increases, as well. In that case, the toner in the developing device 33 may be softened or fused. As a result, in the present embodiment, the cooling fan 29 is installed such that a portion of the air blown by it passes through between the developing device 33 and the exposure device 34, as indicated by a dotted line arrow 29A in FIG. 2.

Figure 5:
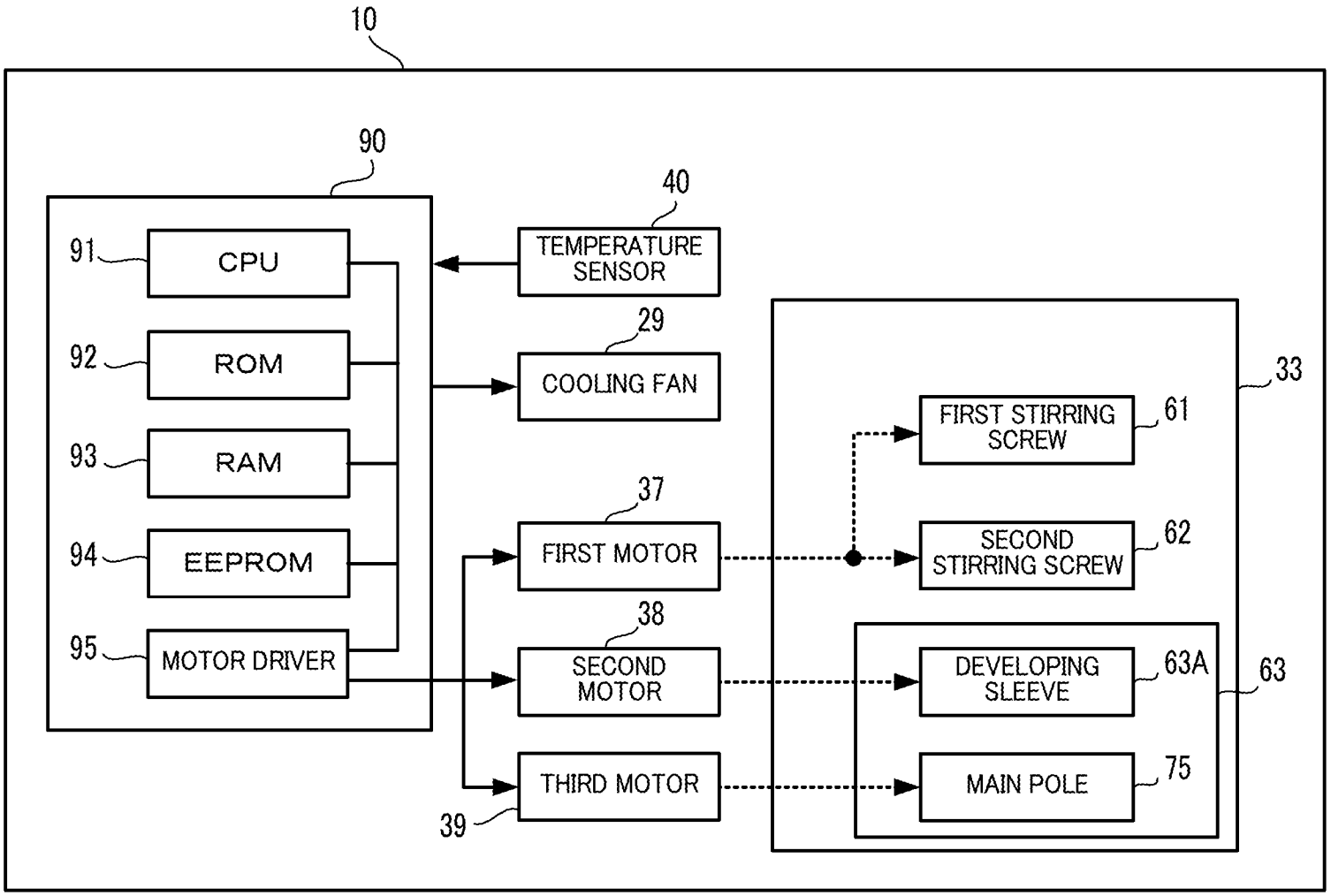
FIG. 5 is a block diagram showing a configuration of a control portion included in the image forming apparatus.

The cooling fan 29 is drive-controlled by the control portion 90 (see FIG. 5). The blowing amount of the cooling fan 29 is controlled stepwise based on a temperature detected by a temperature sensor 40 (see FIG. 5) provided in the housing 14. For example, the control portion 90 stops the cooling fan 29 in a case where the temperature detected by the temperature sensor 40 is lower than a predetermined reference temperature. Here, the reference temperature is, for example, an upper-limit temperature (35° C.) of a normal temperature range (5° C. to 35° C.) regurated by JIS (Japanese Industrial Standards). In addition, the control portion 90 drives the cooling fan 29 to blow a predetermined first blowing amount of air in a case where the detected temperature is equal to or higher than the reference temperature and lower than a predetermined abnormal temperature (for example, 45° C.). That is, when the internal temperature of the housing 14 has become higher than the reference temperature, the control portion 90 sets the blowing amount of the cooling fan 29 to the first blowing amount, and drive-controls the cooling fan 29 to blow the first blowing amount of air. In addition, the control portion 90 drives the cooling fan 29 to blow a second blowing amount of air in a case where the detected temperature is equal to or higher than the abnormal temperature, wherein the second amount is larger than the first amount. That is, when the internal temperature of the housing 14 has become higher than the abnormal temperature, the control portion 90 sets the blowing amount of the cooling fan 29 to the second blowing amount that is larger than the first blowing amount, and drive-controls the cooling fan 29 to blow the second blowing amount of air. It is noted that arbitrary temperatures may be set to drive or stop the cooling fan 29, and the first blowing amount and the second blowing amount may be determined as necessary in correspondence with the heat-generating states of the devices in the image forming apparatus 10. It is noted that the reference temperature is an example of the first temperature of the present disclosure, and the abnormal temperature is an example of the second temperature of the present disclosure.

[Configuration of Developing Device 33]

Figure 3:
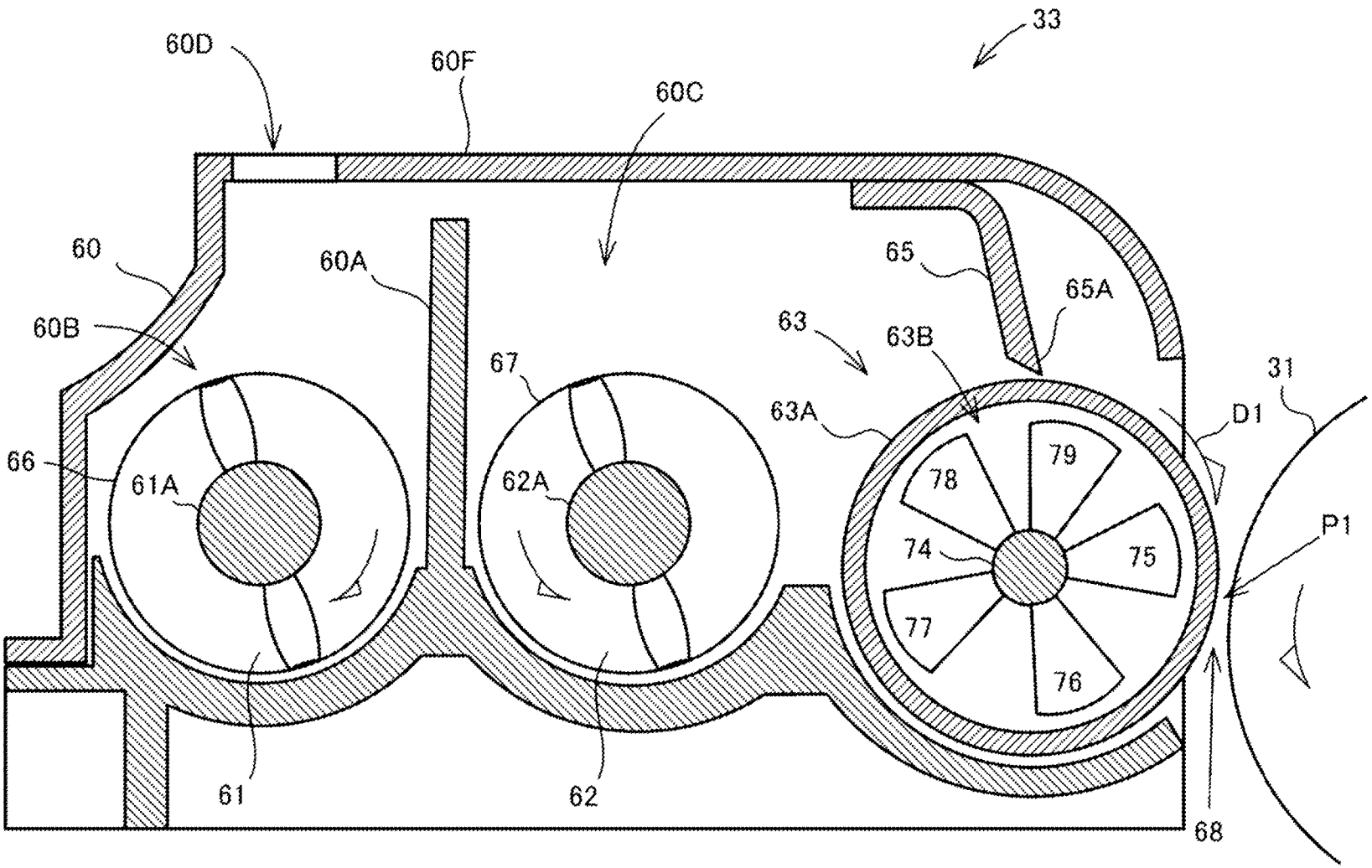
FIG. 3 is a cross-sectional diagram showing a configuration of a developing device included in the image forming apparatus.

FIG. 3 is a cross-sectional diagram showing the configuration of the developing device 33 included in the image forming portion 18. The developing device 33 develops the electrostatic latent image with toner by a non-contact developing system in which the toner is electrostatically adhered to the electrostatic latent image while not in contact with the photoconductor drum 31. As the developer used in the developing, a so-called one-component developer whose main component is magnetic toner, is used. In the present embodiment, as one example, the developing device 33 performs the developing by using the one-component developer.

As shown in FIG. 3, the developing device 33 includes a developer holder 60, a first stirring screw 61, a second stirring screw 62, and a developing roller 63.

The developer holder 60 stores the one-component developer (hereinafter, also referred to as merely "developer") that includes the toner. The developer used in the present embodiment includes external additives such as titanium oxide and silica, as well as the toner. The developer holder 60 stores the developer and plays a role of a housing of the developing device 33. The developer holder 60 is formed to be elongated in the longitudinal direction (a direction vertical to the plane of FIG. 3) of the developing device 33. The developer holder 60 is divided by a partition wall 60A into a first storage chamber 60B and a second storage chamber 60C. The developer is stored in each of the first storage chamber 60B and the second storage chamber 60C. It is noted that the first storage chamber 60B and the second storage chamber 60C are not completely separate from each other, but are communicated with each other by a communication passage (not shown) that is provided to extend in the longitudinal direction of the developing device 33.

The first stirring screw 61 is rotationally provided in the first storage chamber 60B with a blade member 66 of a spiral shape around its axis. The second stirring screw 62 is rotationally provided in the second storage chamber 60C with a blade member 67 of a spiral shape around its axis. The first stirring screw 61 and the second stirring screw 62 are rotationally supported by side walls of the developer holder 60 that are opposite to each other in the longitudinal direction.

A rotational driving force is transmitted from a first motor 37 (see FIG. 5) to a rotation shaft 61A of the first stirring screw 61 and a rotation shaft 62A of the second stirring screw 62. The first motor 37 is a driving source such as a stepping motor that outputs the rotational driving force. The first motor 37 is coupled with the first stirring screw 61 and the second stirring screw 62 via a transmission mechanism such as a gear. With this configuration, the first stirring screw 61 and the second stirring screw 62 are rotated in a predetermined direction, and the developer stored therein is stirred. When the developer is stirred by the first stirring screw 61 and the second stirring screw 62, an electric charge is applied to the toner. In the present embodiment, the developer is cyclically conveyed in one direction in the first storage chamber 60B and the second storage chamber 60C by passing through the communication passage formed in the partition wall 60A.

The developer holder 60 has a supply port 60D. The supply port 60D is formed in a top wall 60F that constitutes a flat wall surface at the top of the first storage chamber 60B. The supply port 60D is a through hole that guides, to the developer holder 60, the toner supplied from a toner container (not shown) provided in the housing 14.

As shown in FIG. 3, the developing roller 63 is rotationally provided in the developer holder 60. Specifically, the developing roller 63 is provided on the right side of the second stirring screw 62 (on the photoconductor drum 31 side) in the second storage chamber 60C. In detail, the developing roller 63 is provided in parallel to the first stirring screw 61, the second stirring screw 62, and the photoconductor drum 31. The developing roller 63 is disposed to face the photoconductor drum 31 across the gap 68.

The developing roller 63 is a roller member that is rotationally driven while keeping the toner which is contained in the developer, on its outer circumferential surface. The developing roller 63 includes a cylindrical developing sleeve 63A. In the present embodiment, a sleeve whose diameter is 16.0 mm is used as the developing sleeve 63A. That is, the diameter of the developing sleeve 63A is 16.0 mm. The developing sleeve 63A is rotationally supported in the second storage chamber 60C. The developing sleeve 63A is constituted from a tube made of aluminum.

The developing roller 63 is disposed to face the photoconductor drum 31. The developing roller 63 is disposed to face the outer circumferential surface of the photoconductor drum 31 across the gap 68 (see FIG. 3). In the present embodiment, an interval between the developing roller 63 and the photoconductor drum 31 in the gap 68 is 0.36 mm.

Upon receiving a rotational driving force from a second motor 38 (see FIG. 5), the developing sleeve 63A of the developing roller 63 rotates in a rotation direction D1 (clockwise in FIG. 3) indicated by an arrow in FIG. 3. The developing sleeve 63A is rotated in a rotation direction that is opposite to the rotation direction of the second stirring screw 62. The second motor 38 is a driving source such as a stepping motor that outputs the rotational driving force. The second motor 38 is coupled with the rotation shaft of the developing sleeve 63A of the developing roller 63 via a transmission mechanism such as a gear. With this configuration, the second motor 38 transmits the rotational driving force to the developing sleeve 63A so as to rotationally drive the developing sleeve 63A. It is noted that in the present embodiment, although the first stirring screw 61, the second stirring screw 62, and the developing sleeve 63A are respectively rotationally driven by separate motors, they may be rotationally driven by one motor in conjunction with each other, for example.

It is noted that the developing sleeve 63A is rotationally driven so as to rotate at a linear speed of 300 mm/s in the normal print mode and the high-quality print mode. In this case, in the normal print mode, the difference in circumferential speed (relative speed difference) between the developing sleeve 63A and the photoconductor drum 31 is 100 mm/s, and the circumferential speed ratio of the developing sleeve 63A to the photoconductor drum 31 is 1.5 (1.5 times). In addition, in the high-quality print mode, the difference in circumferential speed (relative speed difference) between the developing sleeve 63A and the photoconductor drum 31 is 200 mm/s, and the circumferential speed ratio of the developing sleeve 63A to the photoconductor drum 31 is 3.0 (three times).

Furthermore, in the present embodiment, the developing sleeve 63A is rotationally driven to rotate at a linear speed of 400 mm/s in a case where the apparatus is in the high-quality print mode, and the internal temperature of the housing 14 is equal to or higher than the abnormal temperature that is higher than the reference temperature. In this case, the difference in circumferential speed (relative speed difference) between the developing sleeve 63A and the photoconductor drum 31 is 300 mm/s, and the circumferential speed ratio of the developing sleeve 63A to the photoconductor drum 31 is 4.0 (four times).

The developing roller 63 includes a magnet unit 63B that includes a plurality of magnetic poles. The magnet unit 63B is provided in an inside of the developing sleeve 63A. The magnet unit 63B is fixed to, for example, an internal frame of the housing 14. As a result, the magnet unit 63B does not rotate even when the developing sleeve 63A rotates. In the present embodiment, the magnet unit 63B includes five magnetic poles: a main pole 75 (an example of the developing magnetic pole of the present disclosure); a carrying pole 76; a peeling pole 77; a draw-up pole 78; and a regulation pole 79. The magnetic poles 75 to 79 are each constituted from a permanent magnet that generates a magnetic force.

The main pole 75 generates a peak magnetic force in the gap 68 that includes a facing position P1 at which the developing roller 63 faces the photoconductor drum 31, and generates a magnetic field in the gap 68 by the peak magnetic force. The main pole 75 is attached to the magnet unit 63B in a state where the magnetic pole face thereof is oriented toward the photoconductor drum 31. It is noted that the facing position P1 is, in the gap 68, on a straight line L1 that connects the center of the developing roller 63 and the center of the photoconductor drum 31.

The carrying pole 76 has an opposite polarity to the main pole 75, generates a magnetic field in a circumferential direction of the developing sleeve 63A, and keeps and carries the developer on the developing sleeve 63A in the circumferential direction.

The peeling pole 77 forms a peeling region that has substantially zero magnetic flux density on an opposite side to the photoconductor drum 31 on the developing sleeve 63A. When the developer is carried to the peeling region, the force that magnetically attracts the developer is lost, and the developer is peeled off from the peeling region. The peeled developer is returned to the second storage chamber 60C, and is conveyed again while stirred by the second stirring screw 62. After stirred and conveyed by the second stirring screw 62, the developer is drawn up onto the developing sleeve 63A again by the draw-up pole 78 as appropriately charged developer.

The draw-up pole 78 causes the developer to be attracted and adsorbed on the surface of the developing sleeve 63A by a magnetic force. The draw-up pole 78 causes the developer to be carried on the surface of the developing sleeve 63A. The developing sleeve 63A is rotated in this state, and thereby the developer is carried to the facing position P1 that faces the photoconductor drum 31.

A regulation blade 65 is provided in the developer holder 60. The regulation blade 65 is constituted from a magnetic substance, and is, for example, a plate-like member made of a metal having magnetism. The regulation blade 65 is formed to extend in the longitudinal direction (a direction vertical to the plane of FIG. 3) of the developer holder 60. The regulation blade 65 is disposed on the upstream side of the facing position P1 in the rotation direction D1 of the developing roller 63 (clockwise in FIG. 3). A slight gap is formed between a tip portion 65A of the regulation blade 65 and the roller surface of the developing roller 63. The developer that has adhered to the developing roller 63 is regulated by the regulation blade 65 to a thickness that corresponds to the gap.

The regulation pole 79, while generating a peak magnetic force at a position on the developing sleeve 63A that faces the regulation blade 65, keeps and carries the developer on the developing sleeve 63A in the circumferential direction so that the developer passes through the gap between the regulation blade 65 and the developing sleeve 63A.

Figure 4:
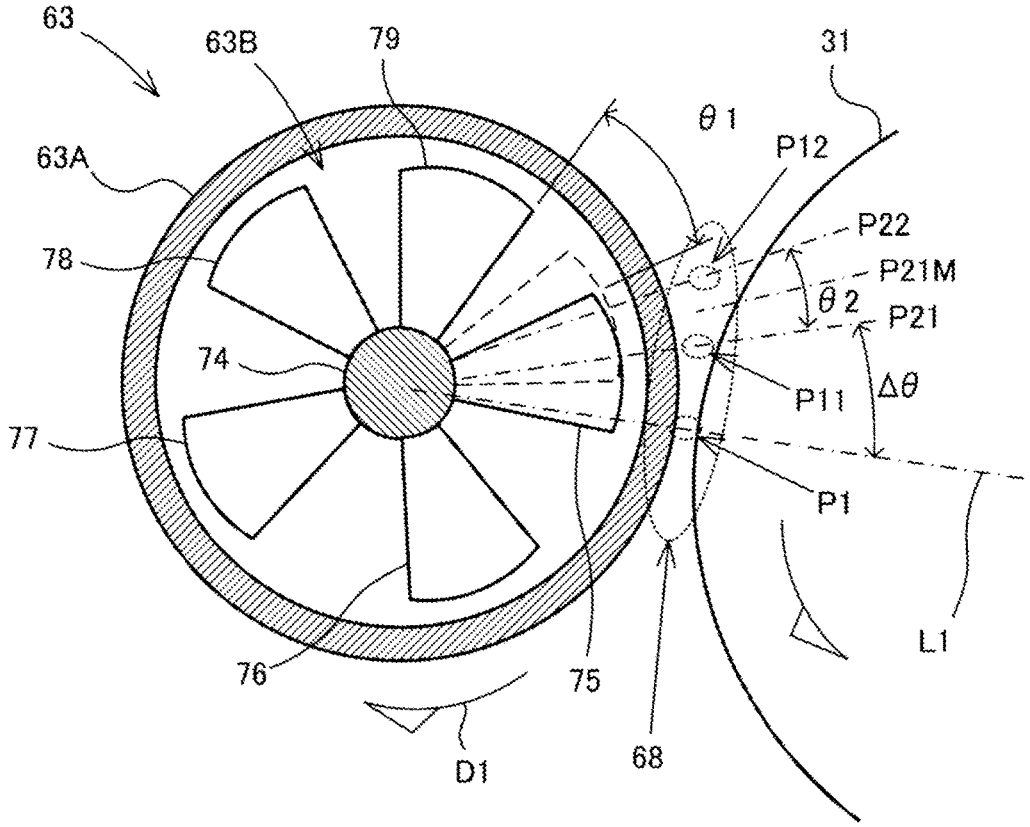
FIG. 4 is an enlargement diagram of a developing roller included in the developing device.

In the present embodiment, the main pole 75 is configured to be pivoted (displaced) around an axis of the magnet unit 63B. The main pole 75 is supported by a movable bracket (not shown). The movable bracket is pivotably supported by a support shaft 74 located at the center of the magnet unit 63B. With this configuration, the main pole 75 can pivot around the axis of the support shaft 74 of the magnet unit 63B. As shown in FIG. 4, in the inside of the developing sleeve 63A, the main pole 75 is supported by the magnet unit 63B so as to be able to pivot between a first magnetic pole position P21 and a second magnetic pole position P22.

At both of the first magnetic pole position P21 and the second magnetic pole position P22, the main pole 75 can generate a magnetic field in the gap 68. In FIG. 4, the main pole 75 represented by a solid line is located at the first magnetic pole position P21. When the main pole 75 is located at the first magnetic pole position P21, a peak magnetic force is applied to a predetermined first position P11 (an example of the first position of the present disclosure) in the gap 68, and a magnetic field is generated in the gap 68. The first position P11 is on the upstream side of the facing position P1 in the rotation direction D1, and separate from the facing position P1 by angle $\Delta\theta$. In FIG. 4, the main pole 75 represented by a dotted line is located at the second magnetic pole position P22. When the main pole 75 is located at the second magnetic pole position P22, a peak magnetic force is applied to a second position P12 (an example of the second position of the present disclosure) in the gap 68, and a magnetic field is generated in the gap 68. The second position P12 is on the upstream side of the first position P11 in the rotation direction D1 of the developing roller 63, and separate from the first position P11 by a predetermined angle $\theta 2$.

In the present embodiment, the second magnetic pole position P22 is determined so as to prevent the main pole 75 from approaching the regulation pole 79 close enough to make the strength of the magnetic field in the gap 68 lower than a reference value. Specifically, the angle $\theta 2$ that defines the second magnetic pole position P22, is determined to be equal to or smaller than a half of an angle $\theta 1$ that corresponds to an interval between the main pole 75 and the regulation pole 79.

A third motor 39 (see FIG. 5) transmits a rotational driving force to the movable bracket of the main pole 75. The third motor 39 is a driving source such as a stepping motor that outputs the rotational driving force. The third motor 39 is coupled with the movable bracket via a transmission mechanism such as a gear. With this configuration, the main pole 75 together with the movable bracket can be displaced between the first magnetic pole position P21 and the second magnetic pole position P22. In the present embodiment, a magnetic pole position correcting process that is described below, is executed so that the main pole 75 is disposed at any of three positions: the first magnetic pole position P21; an intermediate magnetic pole position P21M that is located between the first magnetic pole position P21 and the second magnetic pole position P22; and the second magnetic pole position P22. Here, the intermediate magnetic pole position P21M is a position rotated 10 degrees from the first magnetic pole position P21 toward the upstream side in the rotation direction D1 of the developing sleeve 63A, and the second magnetic pole position P22 is a position rotated 15 degrees from the first magnetic pole position P21 toward the upstream side in the rotation direction D1 of the developing sleeve 63A.

[Configuration of Control Portion 90]

Next, a description is given of the control portion 90 with reference to FIG. 5. The control portion 90 comprehensively controls the image forming apparatus 10. As shown in FIG. 5, the control portion 90 includes a CPU 91, a ROM 92, a RAM 93, an EEPROM™ 94, and a motor driver 95. The ROM 92 is a nonvolatile storage device, the RAM 93 is a volatile storage device, and the EEPROM 94 is a nonvolatile storage device. The RAM 93 and the EEPROM 94 are used as temporary storage memories by various processes executed by the CPU 91. The motor driver 95 drive-controls the first motor 37, the second motor 38, and the third motor 39 individually and independent of each other, based on a control signal from the CPU 91. In addition, the EEPROM 94 stores set values of the reference temperature, the abnormal temperature, the first blowing amount, and the second blowing amount as thresholds used in controlling the driving and stopping of the cooling fan 29 and adjusting the blowing amount of the cooling fan 29. In addition, set values and various types of information used in the magnetic pole position correcting process that is described below, are also stored in the EEPROM 94. In addition, a predetermined control program is stored in the ROM 92. It is noted that the control portion 90 may be constituted from an electronic circuit such as an integrated circuit (ASIC, DSP).

The control portion 90 comprehensively controls the image forming apparatus 10 by causing the CPU 91 to execute the predetermined control program stored in the ROM 92. Specifically, a program (image formation processing program) for realizing an image formation is stored in the ROM 92. Furthermore, the ROM 92 stores a control program for executing the magnetic pole position correcting process that is described below, so as to displace the main pole 75 between the first magnetic pole position P21 and the second magnetic pole position P22 when a factor for varying the thickness of the toner image formed on the surface of the photoconductor drum 31 has occurred. It is noted that the control portion 90 that executes the magnetic pole position correcting process is an example of the magnetic pole position control portion of the present disclosure.

The image forming apparatus 10 includes the first motor 37, the second motor 38, the third motor 39, the cooling fan 29, and the temperature sensor 40. The control portion 90 is electrically connected with the first motor 37, the second motor 38, the third motor 39, the cooling fan 29, and the temperature sensor 40 via an internal bus, a signal line and the like. The first motor 37, the second motor 38, and the third motor 39 are individually drive-controlled by the motor driver 95, and the cooling fan 29 is drive-controlled by the control portion 90. In addition, the temperature sensor 40 is configured to detect the temperature in the housing 14, and send a signal indicating the detected temperature to the control portion 90. The control portion 90 determines the temperature in the housing 14 based on the signal sent from the temperature sensor 40.

In the image forming apparatus 10 configured as described above, when the linear speed of the developing sleeve 63A is changed upon change of the operation mode, the position on the photoconductor drum 31 to which the toner flying from the developing sleeve 63A is adhered, is shifted. This has a bad effect on the amount of toner adhered to the toner image on the photoconductor drum 31. Specifically, when the linear speed of the developing sleeve 63A is increased upon change of the operation mode of the image forming apparatus 10 from the normal print mode to the high-quality print mode, the toner on the photoconductor drum 31 is deviated to the downstream side in the rotation direction of the photoconductor drum 31, the thickness of the toner image on the photoconductor drum 31 is varied. In detail, in the toner image, the upstream side in the rotation direction becomes thinner, the downstream side in the rotation direction becomes thicker, and a gradient is generated in thickness from the upstream side to the downstream side in the rotation direction. In view of this problem, in the image forming apparatus 10 of the present embodiment, the magnetic pole position correcting process that is described below is executed by the control portion 90. With this configuration, even if a factor for varying the thickness of the toner image formed on the surface of the photoconductor drum 31 occurs, it is possible to maintain the thickness of the toner image to be uniform.

[Magnetic Pole Position Correcting Process]

Figure 6:
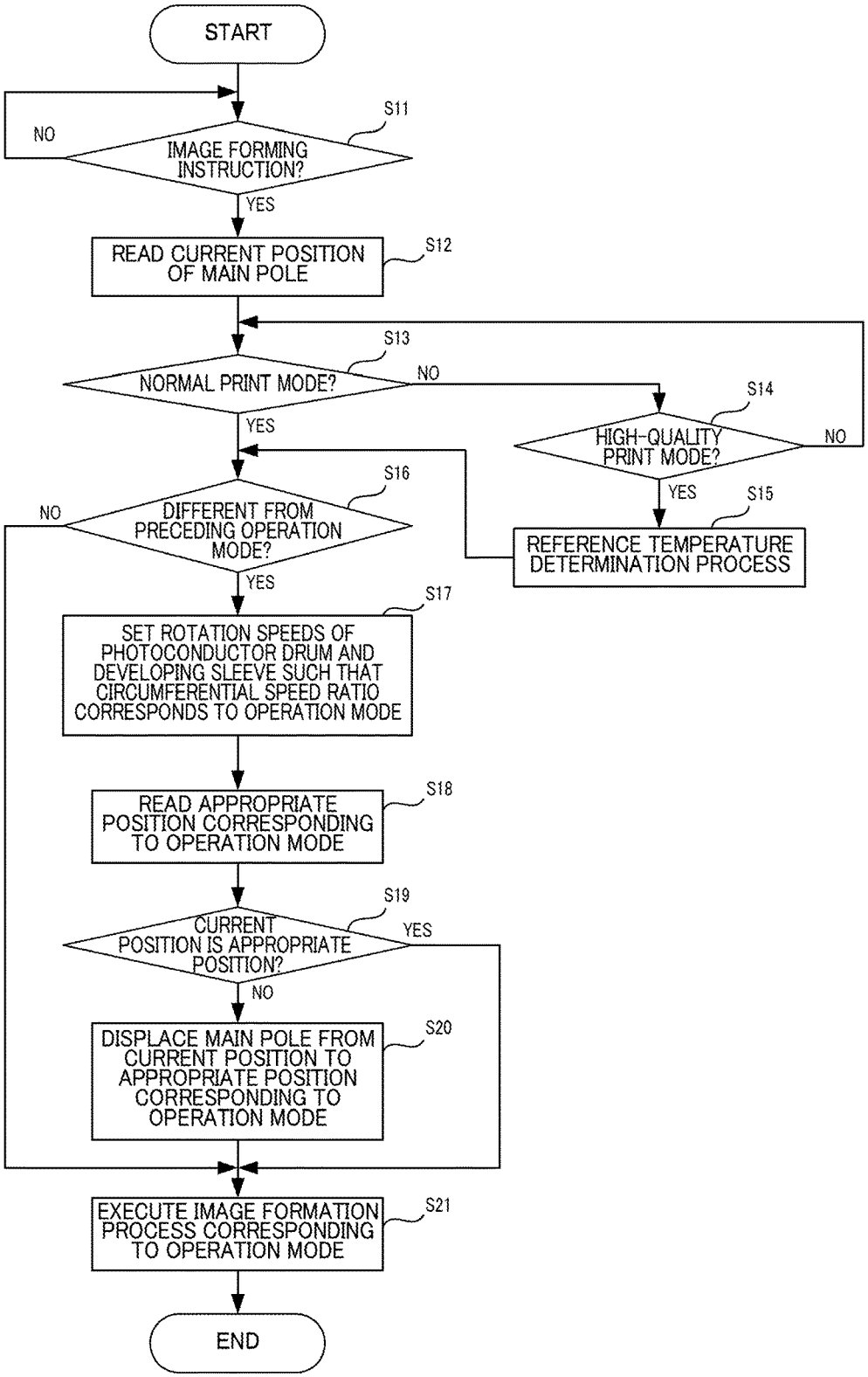
FIG. 6 is a flowchart showing an example of procedures of a magnetic pole position correcting process executed by the control portion of the image forming apparatus.

The following describes an example of the procedures of the magnetic pole position correcting process executed in the image forming apparatus 10 with reference to the flowchart shown in FIG. 6, and describes a magnetic pole position correcting method that is applied to the developing device 33. It is noted that the following description depicts a case where an image forming instruction (for example, a copy instruction or a print instruction) is input from the operation panel 13 of the image forming apparatus 10 or from a printer driver of an externally connected information processing apparatus. Here, S11, S12, . . . in FIG. 6 represent numbers assigned to the processing procedures (steps).

Upon input of an image forming instruction to the image forming apparatus 10 (YES at S11), the control portion 90 reads, from the EEPROM 94, positional information indicating the current position of the main pole 75 (S12). The positional information of the main pole 75 read here is one that was stored in the EEPROM 94 by the control portion 90 during execution of the preceding magnetic pole position correcting process. Of course, the control portion 90 may cause a sensor such as an optical sensor to detect the position of the main pole 75 located between the first magnetic pole position P21 and the second magnetic pole position P22, and obtain information indicating the detected position.

In the next steps S13 and S14, the control portion 90 refers to image quality information included in the input image forming instruction to determine in which of the normal print mode and the high-quality print mode, the operation mode of the image forming portion 18 in the image formation process is. In other words, the control portion 90 determines in which of the normal print mode and the high-quality print mode the image formation process is executed. The control portion 90 determines that the image formation process is executed in the normal print mode when the image forming instruction includes setting information indicating a resolution that is lower than a predetermined resolution (S13). In addition, the control portion 90 determines that the image formation process is executed in the high-quality print mode when the image forming instruction includes setting information indicating a resolution that is equal to or higher than the predetermined resolution (S14).

In addition, upon determining in step S14 that the image formation process is executed in the high-quality print mode, the control portion 90 proceeds to step S15 in which to determine based on a signal sent from the temperature sensor 40 whether or not the temperature in the housing 14 is equal to or higher than the reference temperature. Hereinafter, when the control portion 90 determines in step S14 that the image formation process is executed in the high-quality print mode and determines in step S15 that the temperature in the housing 14 is equal to or higher than the reference temperature, the operation mode determined through these steps is referred to as a high-temperature high-quality print mode. When the determination processes of steps S13 to S15 end, the control portion 90 stores the operation mode determined through these steps to the EEPROM 94.

Next, the control portion 90 determines whether or not the operation mode determined through steps S13 to S15 is different from the operation mode of the preceding image formation process (S16). For the determination, the control portion 90 compares the operation mode stored in the EEPROM 94 during the preceding image formation process with the operation mode determined through the determination processes of steps S13 to S15. As described above, the circumferential speed ratio of the developing sleeve 63A to the photoconductor drum 31 in each of the operation modes is determined in advance. As a result, the process of step S16 to determine whether or not the operation mode determined through steps S13 to S15 is different from the operation mode of the preceding image formation process, substantially corresponds to the circumferential speed ratio determining step of the present disclosure in which it is determined whether or not the circumferential speed of the developing sleeve 63A has changed.

When it is determined in step S16 that the operation mode determined through steps S13 to S15 is different from the operation mode of the preceding image formation process, the control portion 90 proceeds to step S17. On the other hand, when it is determined in step S16 that the operation mode determined through steps S13 to S15 is the same as the operation mode of the preceding image formation process, the control portion 90 proceeds to step S21 to execute the image formation process corresponding to the operation mode.

In step S17, the control portion 90 sets the circumferential speed ratio of the developing sleeve 63A to the photoconductor drum 31 in correspondence with the operation mode determined through steps S13 to S15. In detail, the control portion 90 sets the rotation speeds of the photoconductor drum 31 and the developing sleeve 63A such that the circumferential speed ratio of the developing sleeve 63A to the photoconductor drum 31 corresponds to the operation mode determined through steps S13 to S15. Here, upon determining that the operation mode is the normal print mode, the control portion 90 rotationally drives the photoconductor drum 31 and the developing sleeve 63A so that the circumferential speed ratio of the developing sleeve 63A to the photoconductor drum 31 is 1.5. In addition, upon determining that the operation mode is the high-quality print mode, the control portion 90 rotationally drives the photoconductor drum 31 and the developing sleeve 63A so that the circumferential speed ratio of the developing sleeve 63A to the photoconductor drum 31 is 3.0. In addition, upon determining that the operation mode is the high-temperature high-quality print mode, the control portion 90 rotationally drives the photoconductor drum 31 and the developing sleeve 63A so that the circumferential speed ratio of the developing sleeve 63A to the photoconductor drum 31 is 4.0.

Subsequently, the control portion 90 reads, from the EEPROM 94, an appropriate position of the main pole 75 that corresponds to the operation mode determined through steps S13 to S15 (S18). The EEPROM 94 stores in advance a correspondence table (see Table 1) that indicates appropriate positions respectively corresponding to the operation modes. The control portion 90 reads, from the correspondence table in the EEPROM 94, the appropriate position of the main pole 75 that corresponds to the determined operation mode. In the present embodiment, upon determing that the operation mode is the normal print mode, the control portion 90 reads the first magnetic pole position P21 as the appropriate position of the main pole 75. In addition, upon determing that the operation mode is the high-quality print mode, the control portion 90 reads the intermediate magnetic pole position P21M as the appropriate position of the main pole 75. In addition, upon determing that the operation mode is the high-temperature high-quality print mode, the control portion 90 reads the second magnetic pole position P22 as the appropriate position of the main pole 75.

TABLE 1

| Operation mode | Appropriate position of main pole |
|---|---|
| Normal print mode (circumferential speed ratio: 1.5) | First magnetic pole position P21 |
| High-quality print mode (circumferential speed ratio: 3.0) | Intermediate magnetic pole position P21M |
| High-temperature high-quality print mode (circumferential speed ratio: 4.0) | Second magnetic pole position P22 |

Here, the appropriate position of the main pole 75 refers to a position to which the main pole 75 may be displaced upon occurrence of a change in the circumferential speed ratio so that the gradient or the variation in thickness is not generated in the toner image on the photoconductor drum 31 after the development. This is because, as described above, if a change in the circumferential speed ratio of the developing sleeve 63A to the photoconductor drum 31 occurs, a gradient or a variation in thickness would be generated in the toner image on the photoconductor drum 31 after the development, due to the change in the circumferential speed ratio. In the present embodiment, in the normal print mode, the circumferential speed ratio of the developing sleeve 63A to the photoconductor drum 31 is 1.5, and thus the first magnetic pole position P21 is determined as an appropriate position corresponding to the circumferential speed ratio. In addition, in the high-quality print mode, the circumferential speed ratio of the developing sleeve 63A to the photoconductor drum 31 is 3.0, and thus the intermediate magnetic pole position P21M is determined as an appropriate position corresponding to the circumferential speed ratio. In addition, in the high-temperature high-quality print mode, the circumferential speed ratio of the developing sleeve 63A to the photoconductor drum 31 is 4.0, and thus the second magnetic pole position P22 is determined as an appropriate position corresponding to the circumferential speed ratio.

As described above, the intermediate magnetic pole position P21M is a position rotated 10 degrees from the first magnetic pole position P21 toward the upstream side in the rotation direction D1 of the developing sleeve 63A, and the second magnetic pole position P22 is a position rotated 15 degrees from the first magnetic pole position P21 toward the upstream side in the rotation direction D1 of the developing sleeve 63A. The interval between the magnetic pole positions P21, P21M, and P22, namely the displacement amount of the main pole 75 can be determined based on the amount of change between the circumferential speed ratios that correspond to the operation modes before and after the displacement. For example, the displacement amount of the main pole 75 can be determined so as to be proportional to the amount of change of the circumferential speed ratio. Specifically, when the linear speed of the developing sleeve 63A is increased due to an increase of the circumferential speed ratio, the displacement amount of the main pole 75 is determined based on the increase amount of the linear speed of the developing sleeve 63A. In addition, when the linear speed of the developing sleeve 63A is decreased due to a decrease of the circumferential speed ratio, the displacement amount of the main pole 75 is determined based on the decrease amount of the linear speed of the developing sleeve 63A.

In step S19, the control portion 90 determines whether or not the current position of the main pole 75 is the appropriate position corresponding to the operation mode. Specifically, the control portion 90 compares the current position read in step S12 with the appropriate position read in step S16, and the control portion 90 determines that the current position of the main pole 75 is the appropriate position when the current position matches the read appropriate position. When it is judged that the current position of the main pole 75 is the appropriate position, the process proceeds to step S21 in which to execute an image formation process corresponding to the operation mode.

On the other hand, upon determining in step S19 that the current position does not match the read appropriate position, namely, the current position read in step S12 does not match the appropriate position read in step S18, the control portion 90 determines that the current position of the main pole 75 is not the appropriate position. Here, if the image formation process was performed in a state where the main pole 75 is disposed at the first magnetic pole position P21 although the operation mode is the high-quality print mode, the upstream side in the rotation direction would become thinner, the downstream side in the rotation direction would become thicker, and a gradient would be generated in thickness from the upstream side to the downstream side in the rotation direction, in the toner image on the photoconductor drum 31 after the developing. In addition, if the image formation process was performed in a state where the main pole 75 is disposed at the second magnetic pole position P22 although the operation mode is the high-quality print mode, the downstream side in the rotation direction would become thinner, the upstream side in the rotation direction would become thicker, and a gradient would be generated in thickness from the downstream side to the upstream side in the rotation direction, in the toner image on the photoconductor drum 31 after the developing.

Accordingly, upon determining in step S19 that the current position of the main pole 75 is not the appropriate position, the control portion 90 proceeds to step S20 in which to drive-control the third motor 39 so as to move the main pole 75 to the appropriate position read in step S16.

For example, when the main pole 75 is disposed at the first magnetic pole position P21 or the second magnetic pole position P22 although the operation mode is the high-quality print mode, the control portion 90 displaces the main pole 75 to the intermediate magnetic pole position P21M that is the appropriate position. Specifically, when the operation mode is changed from the normal print mode to the high-quality print mode, the circumferential speed ratio of the developing sleeve 63A to the photoconductor drum 31 is changed from 1.5 to 3.0, and the linear speed of the developing sleeve 63A is increased. When the circumferential speed ratio of the developing sleeve 63A to the photoconductor drum 31 is increased in this way, the main pole 75 is displaced from the first magnetic pole position P21 to the intermediate magnetic pole position P21M based on the amount of change (amount of increased speed). In addition, when the operation mode is changed from the high-temperature high-quality print mode to the high-quality print mode, the circumferential speed ratio of the developing sleeve 63A to the photoconductor drum 31 is changed from 4.0 to 3.0, and thus the linear speed of the developing sleeve 63A is decreased. In this way, when the circumferential speed ratio of the developing sleeve 63A to the photoconductor drum 31 is decreased, the main pole 75 is displaced from the second magnetic pole position P22 to the intermediate magnetic pole position P21M based on the amount of change (amount of decreased speed).

In addition, when the main pole 75 is disposed at the intermediate magnetic pole position P21M or the second magnetic pole position P22 although the operation mode is the normal print mode, the control portion 90 displaces the main pole 75 to the first magnetic pole position P21 that is the appropriate position. Specifically, when the operation mode is changed from the high-quality print mode to the normal print mode, the circumferential speed ratio of the developing sleeve 63A to the photoconductor drum 31 is changed from 3.0 to 1.5, and the linear speed of the developing sleeve 63A is decreased. When the circumferential speed ratio of the developing sleeve 63A to the photoconductor drum 31 is decreased in this way, the main pole 75 is displaced from the intermediate magnetic pole position P21M to the first magnetic pole position P21 based on the amount of change (amount of decreased speed). In addition, when the operation mode is changed from the high-temperature high-quality print mode to the normal print mode, the circumferential speed ratio of the developing sleeve 63A to the photoconductor drum 31 is changed from 4.0 to 1.5, and thus the linear speed of the developing sleeve 63A is decreased. In this way, when the circumferential speed ratio of the developing sleeve 63A to the photoconductor drum 31 is decreased, the main pole 75 is displaced from the second magnetic pole position P22 to the first magnetic pole position P21 based on the amount of change (amount of decreased speed).

In addition, when the main pole 75 is disposed at the first magnetic pole position P21 or the intermediate magnetic pole position P21M although the operation mode is the high-temperature high-quality print mode, the control portion 90 displaces the main pole 75 to the second magnetic pole position P22 that is the appropriate position. Specifically, when the operation mode is changed from the high-quality print mode to the high-temperature high-quality print mode, the circumferential speed ratio of the developing sleeve 63A to the photoconductor drum 31 is changed from 3.0 to 4.0, and the linear speed of the developing sleeve 63A is increased. When the circumferential speed ratio of the developing sleeve 63A to the photoconductor drum 31 is increased in this way, the main pole 75 is displaced from the intermediate magnetic pole position P21M to the second magnetic pole position P22 based on the amount of change (amount of increased speed). In addition, when the operation mode is changed from the normal print mode to the high-temperature high-quality print mode, the circumferential speed ratio of the developing sleeve 63A to the photoconductor drum 31 is changed from 1.5 to 4.0, and thus the linear speed of the developing sleeve 63A is increased. When the circumferential speed ratio of the developing sleeve 63A to the photoconductor drum 31 is increased in this way, the main pole 75 is displaced from the first magnetic pole position P21 to the second magnetic pole position P22 based on the amount of change (amount of increased speed).

Subsequently, in step S21, the image formation process corresponding to the operation mode is executed, and a series of processes end. It is noted that the above-described step S20 in which the main pole 75 is displaced to the appropriate position, corresponds to the position correcting step of the present disclosure.

The image forming apparatus 10 of the first embodiment executes the magnetic pole position correcting process as described above. As a result, even if, as a factor for varying the thickness of the toner image formed on the surface of the photoconductor drum 31, the linear speed of the developing sleeve 63A is changed and the circumferential speed ratio of the developing sleeve 63A to the photoconductor drum 31 is changed due to change of the operation mode of the image forming apparatus 10, the main pole 75 is displaced to an appropriate position as described above. With this configuration, the position of the magnetic field generated by the main pole 75 after the displacement is changed as well, and affected by this, the flying trajectory of the toner flying to the photoconductor drum 31 is corrected, thereby the toner reaches appropriate adhering positions. This makes it possible to maintain the thickness of the toner image to be uniform.

It is noted that the first embodiment describes a processing example where, in the magnetic pole position correcting process, when the operation mode is changed, the main pole 75 is displaced to a magnetic pole position that corresponds to the circumferential speed ratio of the developing sleeve 63A to the photoconductor drum 31 that corresponds to the operation mode after the change. However, the present disclosure is not limited to the processing example. For example, the control portion 90 may calculate the circumferential speed ratio of the developing sleeve 63A to the photoconductor drum 31 from the number of rotations of each of the photoconductor drum 31 and the developing sleeve 63A, determine the amount of change between the circumferential speed ratios that correspond to the operation modes before and after the change, and displace the main pole 75 by a displacement amount corresponding to the determined amount of change.

Second Embodiment

Next, a description is given of other examples of the magnetic pole position correcting process and the magnetic pole position correcting method according to a second embodiment of the present disclosure. In the second embodiment, the magnetic pole position correcting process is different from that in the first embodiment, and other than that, the second embodiment has the same configuration as the first embodiment. Accordingly, in the following description, only the magnetic pole position correcting process is described, and description of the other configuration is omitted.

In the image forming apparatus 10 of the present embodiment, the cooling fan 29 is provided in the housing 14. As described above, the cooling fan 29 is installed such that a portion of the air blown by it passes through between the developing device 33 and the exposure device 34 (see FIG. 2). In the image forming apparatus 10 configured as such, the air from the cooling fan 29 passes through the gap 68 between the photoconductor drum 31 and the developing sleeve 63A from the upper side to the lower side. In this case, when the blowing amount of the cooling fan 29 is adjusted in correspondence with the temperature inside the image forming apparatus 10, the position on the photoconductor drum 31 to which the toner flying from the developing sleeve 63A is adhered is shifted. This has a bad effect on the amount of toner adhered to the toner image on the photoconductor drum 31. Specifically, when the blowing amount of the cooling fan 29 is increased in correspondence with an increase of the internal temperature of the housing 14, the toner on the photoconductor drum 31 is deviated to the downstream side in the air blowing direction, and the thickness of the toner image on the photoconductor drum 31 is varied. Specifically, in the toner image, the upstream side in the air blowing direction becomes thinner, the downstream side in the air blowing direction becomes thicker, and a gradient is generated in thickness from the upstream side to the downstream side in the air blowing direction. In view of this problem, in the image forming apparatus 10 of the second embodiment, the magnetic pole position correcting process that is described below is executed by the control portion 90. With this configuration, even if a factor for varying the thickness of the toner image formed on the surface of the photoconductor drum 31 occurs, it is possible to maintain the thickness of the toner image to be uniform.

[Magnetic Pole Position Correcting Process]

Figure 7:
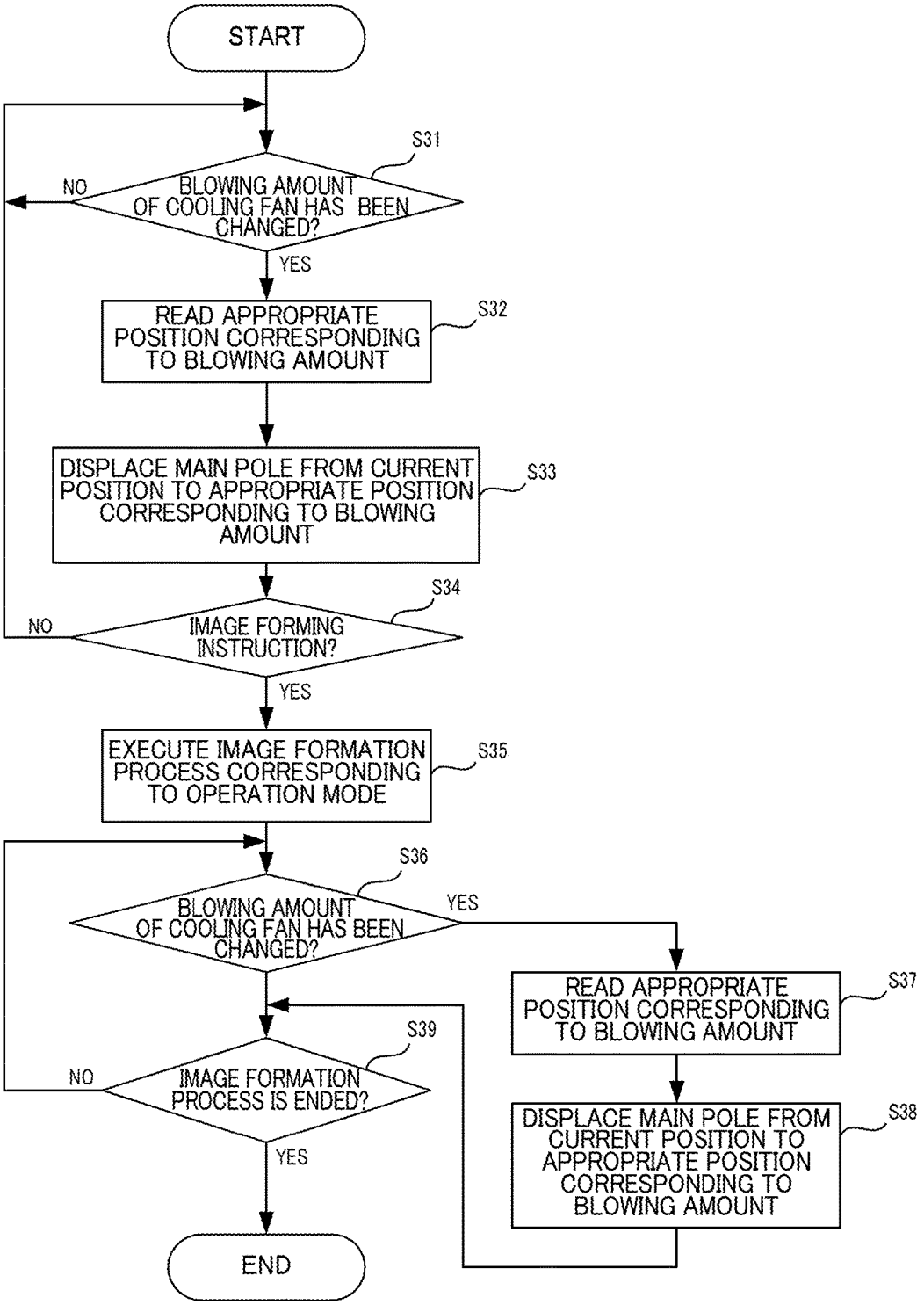
FIG. 7 is a flowchart showing an example of procedures of a magnetic pole position correcting process executed by the control portion of the image forming apparatus.

The following describes an example of the procedures of the magnetic pole position correcting process according to the second embodiment of the present disclosure with reference to the flowchart shown in FIG. 7, and describes a magnetic pole position correcting method that is applied to the developing device 33. It is noted that in the following description, it is supposed that the process of step S31 starts in a state where the image forming apparatus 10 is not performing the image formation process. In addition, regardless of the operation mode of the image forming apparatus 10, the image forming apparatus 10 operates in a state where the circumferential speed ratio of the developing sleeve 63A to the photoconductor drum 31 is 1.5. Here, S31, S32, . . . in FIG. 7 represent numbers assigned to the processing procedures (steps).

In step S31, the control portion 90 determines whether or not the driving state of the cooling fan 29 has been changed. Specifically, the control portion 90 determines whether the blowing amount of the cooling fan 29 has been changed to any of; a state of windlessness with the fan stopped; the first blowing amount; or the second blowing amount. When the internal temperature of the housing 14 increases to be equal to or higher than the reference temperature and lower than the abnormal temperature, the cooling fan 29 is driven with the first blowing amount. In this case, the control portion 90 determines that the blowing amount has been changed from the state of windlessness to the first blowing amount. In addition, when the internal temperature increases to be equal to or higher than the abnormal temperature, the cooling fan 29 is driven with the second blowing amount. In this case, the control portion 90 determines that the blowing amount has been changed from the first blowing amount to the second blowing amount. It is noted that when the internal temperature decreases, the determination is made in a similar manner. It is noted that step S31 in which to determine whether the blowing amount of the cooling fan 29 has been changed, corresponds to the blowing amount determining step of the present disclosure.

Subsequently, in step S32, the control portion 90 reads, from the EEPROM 94, an appropriate position of the main pole 75 that corresponds to the blowing amount determined in step S31. The EEPROM 94 stores in advance a correspondence table (see Table 2) that indicates appropriate positions corresponding to the blowing amounts. The control portion 90 reads, from the correspondence table in the EEPROM 94, the appropriate position that corresponds to the determined blowing amount. In the present embodiment, upon determing that the blowing amount is the state of windlessness, the control portion 90 reads the first magnetic pole position P21 as the appropriate position of the main pole 75. In addition, upon determing that the blowing amount is the first blowing amount, the control portion 90 reads the intermediate magnetic pole position P21M as the appropriate position of the main pole 75. In addition, upon determing that the blowing amount is the second blowing amount, the control portion 90 reads the second magnetic pole position P22 as the appropriate position of the main pole 75.

TABLE 2

| Blowing amount | Appropriate position of main pole |
|---|---|
| State of windlessness | First magnetic pole position P21 |
| First blowing amount | Intermediate magnetic pole position P21M |
| Second blowing amount | Second magnetic pole position P22 |

Here, the appropriate position of the main pole 75 refers to a position to which the main pole 75 may be displaced upon occurrence of a change in the blowing amount so that the gradient or the variation in thickness is not generated in the toner image on the photoconductor drum 31 after the development. This is because, as described above, if a change in the blowing amount occurs, a gradient or a variation in thickness would be generated in the toner image on the photoconductor drum 31 after the development, due to the change in the blowing amount of the cooling fan 29. In the present embodiment, the first magnetic pole position P21 is determined as an appropriate position corresponding to the state of windlessness. In addition, the intermediate magnetic pole position P21M is determined as an appropriate position corresponding to the first blowing amount. In addition, the second magnetic pole position P22 is determined as an appropriate position corresponding to the second blowing amount.

The interval between the magnetic pole positions P21, P21M, and P22, namely the displacement amount of the main pole 75 can be determined based on the amount of change between the blowing amounts before and after the change. For example, the displacement amount of the main pole 75 can be determined so as to be proportional to the amount of change of the blowing amount. Specifically, when the blowing amount of the cooling fan 29 is increased, the displacement amount of the main pole 75 is determined based on the increase amount of the blowing amount. In addition, when the blowing amount of the cooling fan 29 is decreased, the displacement amount of the main pole 75 is determined based on the decrease amount of the blowing amount.

Subsequently, in step S33, the control portion 90 drive-controls the third motor 39 to move the main pole 75 to the appropriate position read in step S32 so that the gradient is not generated in the toner image.

For example, when the cooling fan 29 is driven with the first blowing amount from the stopped state, the control portion 90 displaces the main pole 75 from the first magnetic pole position P21 to the intermediate magnetic pole position P21M. In addition, when the blowing amount of the cooling fan 29 is changed (increased) from the first blowing amount to the second blowing amount, the control portion 90 displaces the main pole 75 from the intermediate magnetic pole position P21M to the second magnetic pole position P22. Conversely, when the blowing amount of the cooling fan 29 is changed (decreased) from the second blowing amount to the first blowing amount, the control portion 90 displaces the main pole 75 from the second magnetic pole position P22 to the intermediate magnetic pole position P21M. In addition, when the cooling fan 29 is stopped and the blowing amount is changed from the first blowing amount to the state of windlessness, the control portion 90 displaces the main pole 75 from the intermediate magnetic pole position P21M to the first magnetic pole position P21. It is noted that the above-described step S33 in which to displace the main pole 75 to the appropriate position corresponds to the position correcting step of the present disclosure.

Upon input of an image forming instruction to the image forming apparatus 10 (YES at S34), the control portion 90 executes the image formation process corresponding to the operation mode while maintaining the main pole 75 at the current position (S35).

Subsequently, during the image formation process, when the driving state of the cooling fan 29 is changed and the blowing amount of the cooling fan 29 is changed (YES at S36), as in the above-described process of step S32, the control portion 90 reads, from the EEPROM 94, an appropriate position of the main pole 75 that corresponds to the blowing amount after the change (S37), and as in the above-described process of step S33, the control portion 90 drive-controls the third motor 39 to move the main pole 75 to the appropriate position read in step S37 so that the gradient is not generated in the toner image (S38). It is noted that the processes of steps S36 to S38 are repeatedly performed each time the blowing amount is changed until it is determined in step S39 that the image formation process is ended. It is noted that the above-described step S36 corresponds to the blowing amount determining step of the present disclosure, and the above-described step S38 corresponds to the position correcting step.

The image forming apparatus 10 of the second embodiment configured as such executes the magnetic pole position correcting process as described above. As a result, even if, as a factor for varying the thickness of the toner image formed on the surface of the photoconductor drum 31, the blowing amount of the cooling fan 29 is changed and the blowing amount of air that passes through the gap 68 downward is changed, the main pole 75 is displaced to an appropriate position as described above. With this configuration, the position of the magnetic field generated by the main pole 75 after the displacement is changed as well, and affected by this, the flying trajectory of the toner flying to the photoconductor drum 31 is corrected, thereby the toner reaches appropriate adhering positions. This makes it possible to maintain the thickness of the toner image to be uniform.

It is noted that the second embodiment describes a processing example where, in the magnetic pole position correcting process, when the blowing amount is changed, the main pole 75 is displaced to a magnetic pole position that corresponds to the blowing amount after the change. However, the present disclosure is not limited to the processing example. For example, the control portion 90 may determine the amount of change between the blowing amounts before and after the change of the blowing amount, and displace the main pole 75 by an amount of displacement corresponding to the determined amount of change.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developing roller disposed to face an image carrier across a predetermined gap and configured to be rotationally driven, the image carrier being configured to keep a toner image formed from supplied toner on an outer circumferential surface of the image carrier; and a developing magnetic pole provided in an inside of the developing roller, configured to generate a magnetic field in the gap, and configured to be displaced between a first magnetic pole position to generate the magnetic field at a predetermined first position in the gap, and a second magnetic pole position to generate the magnetic field at a second position in the gap, the second position being on an upstream side of the first position in a rotation direction of the developing roller, wherein when a circumferential speed ratio of the developing roller to the image carrier is increased, the developing magnetic pole is displaced toward the second magnetic pole position, and when the circumferential speed ratio is decreased, the developing magnetic pole is displaced toward the first magnetic pole position.

2. The developing device according to claim 1, wherein a displacement amount of the developing magnetic pole is proportional to an amount of change of the circumferential speed ratio.

3. The developing device according to claim 1, further comprising:

a magnetic pole position control portion configured to determine an amount of change of the circumferential speed ratio, and displace the developing magnetic pole by a displacement amount that corresponds to the determined amount of change.

4. An image forming apparatus comprising:

the developing device according to claim 1;

the image carrier disposed to face the developing roller of the developing device across the gap, configured to keep the toner image on the outer circumferential surface of the image carrier, and configured to be rotationally driven, the toner image being formed from the toner supplied from the developing roller; and a magnetic pole position control portion configured to determine an amount of change of the circumferential speed ratio of the developing roller to the image carrier, and displace the developing magnetic pole by a displacement amount that corresponds to the determined amount of change.

5. The image forming apparatus according to claim 4, wherein in a case where a linear speed of the developing roller has been increased as an operation mode of an image formation process was changed from a low-quality image print mode to a high-quality image print mode, the magnetic pole position control portion displaces the developing magnetic pole toward the second magnetic pole position by a displacement amount that corresponds to an increased amount of the developing roller, and in a case where the linear speed of the developing roller has been decreased as the operation mode of the image formation process was changed from the high-quality image print mode to the low-quality image print mode, the magnetic pole position control portion displaces the developing magnetic pole toward the first magnetic pole position by a displacement amount that corresponds to a decreased amount of the developing roller.

6. A developing device comprising:

a developing roller disposed to face an image carrier across a predetermined gap and configured to be rotationally driven, the image carrier being configured to keep a toner image formed from supplied toner on an outer circumferential surface of the image carrier; and a developing magnetic pole provided in an inside of the developing roller, configured to generate a magnetic field in the gap, and configured to be displaced between a first magnetic pole position to generate the magnetic field at a predetermined first position in the gap, and a second magnetic pole position to generate the magnetic field at a second position in the gap, the second position being on an upstream side of the first position in a rotation direction of the developing roller, wherein when a blowing amount of air passing through the gap from the second position to the first position is increased, the developing magnetic pole is displaced toward the second magnetic pole position, and when the blowing amount is decreased, the developing magnetic pole is displaced toward the first magnetic pole position.

7. The developing device according to claim 6, wherein a displacement amount of the developing magnetic pole is proportional to an amount of change of the blowing amount.

8. The developing device according to claim 6, further comprising:

a magnetic pole position control portion configured to determine an amount of change of the blowing amount, and displace the developing magnetic pole by a displacement amount that corresponds to the determined amount of change.

9. An image forming apparatus comprising:

the developing device according to claim 6;

the image carrier disposed to face the developing roller of the developing device across the gap, configured to keep the toner image on the outer circumferential surface of the image carrier, and configured to be rotationally driven, the toner image being formed from the toner supplied from the developing roller;

an air blowing fan disposed in an inside of an apparatus main body and configured to blow air toward the gap; and a magnetic pole position control portion configured to determine an amount of change of the blowing amount of air passing through the gap from the second position to the first position, and displace the developing magnetic pole by a displacement amount that corresponds to the determined amount of change.

10. The image forming apparatus according to claim 9, wherein in a case where the blowing amount of the air blowing fan has been increased as an internal temperature of the apparatus main body changed from a predetermined first temperature to a second temperature that is higher than the first temperature, the magnetic pole position control portion displaces the developing magnetic pole toward the second magnetic pole position by a displacement amount that corresponds to an increased blowing amount of the air blowing fan, and in a case where the blowing amount of the air blowing fan has been decreased as the internal temperature of the apparatus main body changed from the second temperature to the first temperature, the magnetic pole position control portion displaces the developing magnetic pole toward the first magnetic pole position by a displacement amount that corresponds to a decreased blowing amount of the air blowing fan.

11. A magnetic pole position correcting method for correcting a position of a developing magnetic pole provided in an inside of a developing roller, wherein the developing magnetic pole is configured to be displaced between a first magnetic pole position to generate a magnetic field at a predetermined first position in a predetermined gap between the developing roller and an image carrier, and a second magnetic pole position to generate a magnetic field at a second position in the gap, the second position being on an upstream side of the first position in a rotation direction of the developing roller, the magnetic pole position correcting method comprising:

a circumferential speed ratio determining step of determining whether or not a circumferential speed ratio of the developing roller to the image carrier has changed; and a position correcting step of, when the circumferential speed ratio is larger than before the determination by the circumferential speed ratio determining step, displacing the developing magnetic pole toward the second magnetic pole position, and when the circumferential speed ratio is smaller than before the determination by the circumferential speed ratio determining step, displacing the developing magnetic pole toward the first magnetic pole position.

12. A magnetic pole position correcting method for correcting a position of a developing magnetic pole provided in an inside of a developing roller, wherein the developing magnetic pole is configured to be displaced between a first magnetic pole position to generate a magnetic field at a predetermined first position in a predetermined gap between the developing roller and an image carrier, and a second magnetic pole position to generate a magnetic field at a second position in the gap, the second position being on an upstream side of the first position in a rotation direction of the developing roller, the magnetic pole position correcting method comprising:

a blowing amount determining step of determining whether or not a blowing amount of air passing through the gap from the second position to the first position has changed; and a position correcting step of, when the blowing amount is larger than before the determination by the blowing amount determining step, displacing the developing magnetic pole toward the second magnetic pole position, and when the blowing amount is smaller than before the determination by the blowing amount determining step, displacing the developing magnetic pole toward the first magnetic pole position.

* * * * *